United States Patent [19]

Szuba

[11] Patent Number: 5,038,079

[45] Date of Patent: Aug. 6, 1991

[54] METHOD FOR CONTROLLING FLUORESCENT LAMP DIMMERS AND CIRCUIT FOR PROVIDING SUCH CONTROL

[75] Inventor: Stefan F. Szuba, Park Ridge, Ill.

[73] Assignee: North American Philips Corporation, New York, N.Y.

[21] Appl. No.: 450,143

[22] Filed: Dec. 11, 1989

[51] Int. Cl.[5] ..... H05B 37/02

[52] U.S. Cl. ..... 315/158; 315/156; 315/307; 315/DIG. 7; 250/214 AL

[58] Field of Search ..... 315/307, 151, 156, 158, 315/DIG. 4, DIG. 7; 250/206, 214 A, 214 AL, 214 L

[56] References Cited

U.S. PATENT DOCUMENTS

| | | | |
|---|---|---|---|
| 4,135,116 | 1/1979 | Smith | 315/151 |
| 4,236,101 | 11/1980 | Luchaco | 315/156 |
| 4,464,606 | 8/1984 | Kane | 315/158 |
| 4,514,727 | 4/1985 | Van Antwerp | 250/214 AL |
| 4,585,339 | 4/1986 | Senoo | 250/214 AL |
| 4,658,129 | 4/1987 | Fan | 250/214 AL |
| 4,874,989 | 10/1989 | Nilssen | 315/151 |
| 4,894,527 | 1/1990 | Smith | 250/214 AL |

*Primary Examiner*—Eugene R. LaRoche
*Assistant Examiner*—Son Dinh

[57] ABSTRACT

A method of controlling fluorescent lamps in accordance with any selected one of a family of curves plotting sensed natural and artificial light against lamp output, each curve having a steep portion and a more moderate portion and a circuit for providing such control.

17 Claims, 2 Drawing Sheets

Figure 1:
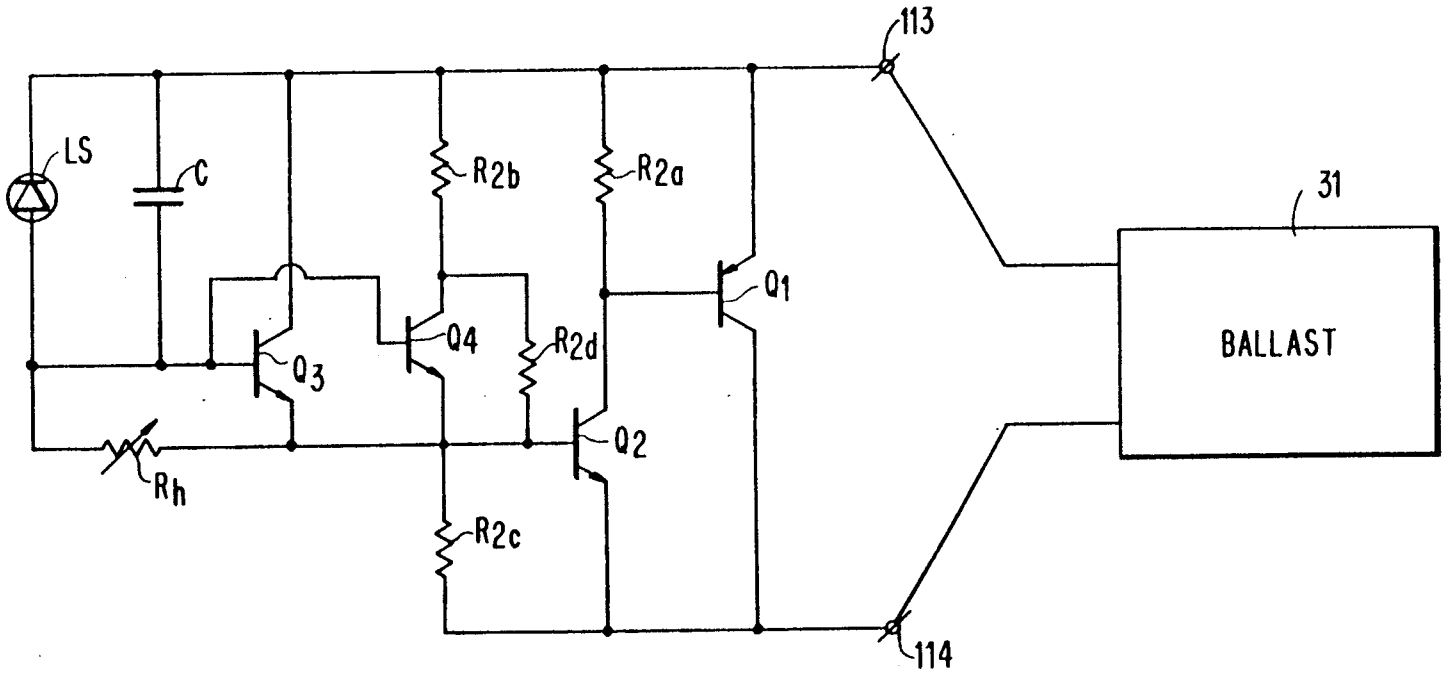

METHOD FOR CONTROLLING FLUORESCENT LAMP DIMMERS AND CIRCUIT FOR PROVIDING SUCH CONTROL

This is an invention in the lighting art. More particularly, it involves a method for controlling fluorescent lamp dimmers. It also involves a control circuit for providing such a method.

This invention is related to that disclosed in U.S. application Ser. No. 403,222 of Stefan F. Szuba filed Sept. 5, 1989 under the title "Dimmer Control Circuit" and assigned to the same assignee as this application. U.S. application Ser. No. 403,222 incorporates by reference U.S. patent application Ser. No. 358,257 now U.S. Pat. No. 5,003,230 issued Mar. 26, 1991 of John M. Wong and Michael A. Kurzak filed on May 26, 1989 and all matter incorporated by reference therein. U.S. application Ser. No. 403,222 and all matter incorporated by reference therein is hereby incorporated by reference herein. In addition, a copy of the descriptive portion of U.S. application Ser. No. 358,257 appears herein as an APPENDIX hereto.

It is an object of this invention to provide a more efficient dimming controller for fluorescent lamps.

One of the advantages of the invention is that it provides higher electrical energy savings than prior dimming controllers.

One of the features of the invention is that it enables one to control the amount of light at a prescribed location more selectively than in the past.

In accordance with one aspect of the invention, there is provided a method for controlling the amount of light provided by fluorescent lamps at a prescribed location. The control is in accordance with any selected one of a family of predetermined curves. Each of the curves plots the amount of lamp light versus the amount of illumination provided by natural light and lamp light. Each of the curves has a portion with a steep slope joined with a portion with a more moderate slope than the steep slope. The method includes sensing the amount of illumination provided at the prescribed location by natural light and by artificial light. It also includes selecting one of the family of curves. The fluorescent lamps are controlled to provide a large amount of light in accordance with the steep slope of the selected curve when the amount of sensed illumination is at a low degree. The lamps are further controlled to provide a lower amount of light than the large amount in accordance with the more moderate portion of the selected curve when the amount of sensed illumination is at a degree higher than the low degree.

In accordance with another aspect of the invention, there is provided a control circuit for a fluorescent lamp dimmer. The control circuit is connected to a ballast for fluorescent lamps. The control circuit operates to control the amount of light provided by the fluorescent lamps at a prescribed location in accordance with any selected one of a family of predetermined curves. Each of the curves plots the amount of light provided by the fluorescent lamps versus the amount of illumination provided by natural light and by the fluorescent lamps at the prescribed location. The circuit includes light sensing means for sensing the amount of illumination at the prescribed location. It also includes selection means for selecting one of the family of curves. Each of the curves has a steep slope when the light sensing means indicates that the fluorescent lamps should provide a high amount of light and a more moderate slope when the light sensing means indicates the fluorescent lamps should provide a lesser amount than the high amount. The control circuit also includes determining means for determining at what amount of light from the fluorescent lamps each of the curves transposes from the sharp slope to the more moderate slope.

Figure 2:
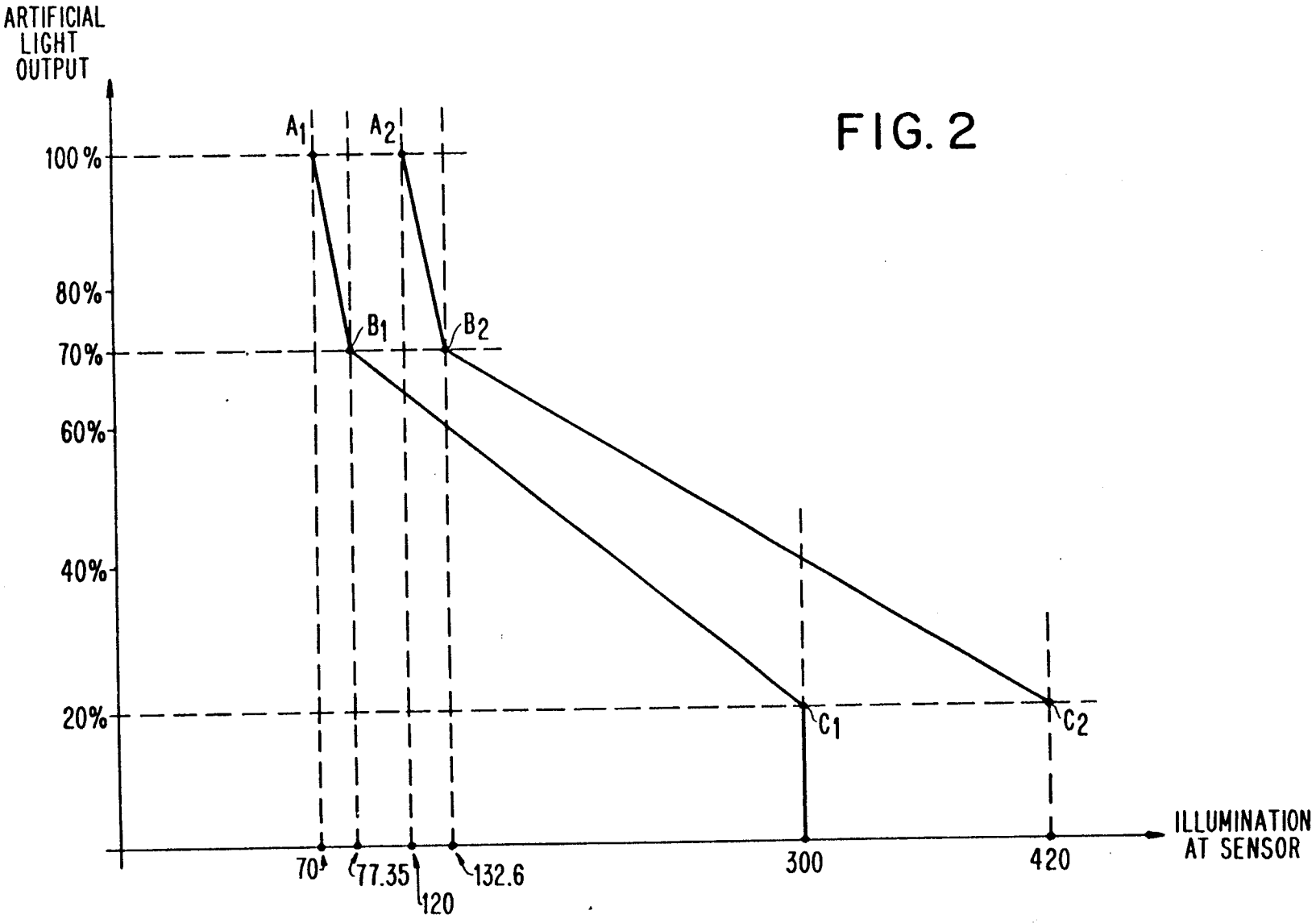

Other objects, features and advantages of the invention will be apparent from the following description and appended claims when considered in conjunction with the accompanying drawing in which, FIG. 1 is a dimmer control circuit provided in accordance with this invention; and FIG. 2 is a family of curves by which the method of this invention may be practiced.

A representation of the control circuit of the invention is shown in FIG. 1 of the drawing wherein the control circuit is connected to terminals 113 and 114 of dimming interface 110 of FIG. 1 of U.S. application Ser. No. 358,257. As can be seen in FIG. 1 hereof, there is provided a light sensor LS which senses light at a particular location. Light sensor LS is connected across capacitor C, one end of which is connected to the base of NPN transistor $Q_3$. The other end of capacitor C is connected to the collector of transistor $Q_3$.

The emitter of transistor $Q_3$ is connected to one end of rheostat $R_h$, the other end of which is connected to one end of light sensor LS and to the base of transistor $Q_3$. The emitter of transistor $Q_3$ is also connected to the base of NPN transistor $Q_2$ and to the emitter of NPN transistor $Q_4$. The bases of transistor $Q_3$ and $Q_4$ are interconnected. The collector of transistor $Q_4$ is connected to one end of resistor $R_{2b}$, the other end of which is connected to the other end of capacitor C. The emitter of transistor $Q_4$ is also connected to one end of resistor $R_{2c}$, the other end of which is connected to terminal 114.

Connected across the emitter and collector of transistor $Q_4$ is resistor $R_{2d}$. The collector of transistor $Q_2$ is connected to one end of resistor $R_{2a}$, the other end of which is connected to the other end of capacitor C. The one end of resistor $R_{2a}$ is also connected to the base of PNP transistor $Q_1$. The other end of resistor $R_{2a}$ is connected to the emitter of transistor $Q_1$. The emitter of transistor $Q_1$ is also connected to terminal 113. The collector of transistor $Q_1$ is connected to terminal 114.

The family of curves shown in FIG. 2 are the result of experimentation at work places. Only two curves of the family are shown. Those skilled in the art will understand from the disclosure herein that many more curves belong to the family. Each curve of FIG. 2 represents the output of fluorescent lamps controlled in accordance with the invention versus the illumination at the light sensor. The upper steep slope portion of each curve, that is, the portion from A to B provides lumen maintenance control and ambient light regulation. The lower part with the more moderate slope, that is, portions B to C of each curve performs ambient light regulation only. It is to be understood that curves of this nature have been selected to provide optimum electrical energy use and optimum quality of lighting. The B points of each curve have been chosen to represent 70% of the maximum of the lamps' output, which maximum is represented as the A point of each curve. Moreover, the slope of the curve was chosen such that the illuminance at the sensor at each B point of each curve is equal to 1.105 times the illuminance at the A point of each curve.

Thus, with A1 being located at 70 lux the control circuit is designed such that point B1 is located at 77.35 lux. In theory it was thought that point C1 could be located at 3.2 times the 70 lux value of A1. In practice, however, it was learned that variations in control circuit parameters between one control circuit and another and the variations in the mounting positions of the light sensor as well as variations in the workplace, made it more desirable to locate point C1 on the A1, B1, C1 curve at 300 lux.

With A2 being located at 120 lux the control circuit is designed such that point B2 is located at 132.6 lux. Again as with the A1, B1, C1 curve, it was thought that point C2 could be located at 3.2 times the 120 lux value of A2. In practice, however, it was again learned that variations in control circuit parameters between one control circuit and another and the variations in the mounting positions of the light sensor as well as variations in the workplace, made it more desirable to locate point C2 on the A2, B2, C2 curve at 420 lux.

In operation, transistors $Q_1$, $Q_2$, $Q_3$ and $Q_4$ are provided power for operation from the dimming interface circuit 110 of FIG. 1 of U.S. application Ser. No. 358,257 associated with the fluorescent lamp or lamps connected to ballast 31. No auxiliary power supply is required with the circuitry of FIG. 1. Rheostat $R_h$ acts as a threshold control or selection means. Transistor $Q_1$ is the main current sink of the invention. Transistor $Q_2$ operates as a regulation amplifier and as a partial current sink. Transistors $Q_3$ and $Q_4$ form a variable gain photo current amplifier. Transistors $Q_3$ and $Q_4$ work in such a way that at low natural light levels they have a high current gain. At this high gain the upper portion A to B of each curve is provided by the fluorescent lamp or lamps being controlled. At higher natural light levels transistor $Q_4$ saturates and this results in a relatively low current gain of the amplifier formed by transistors $Q_3$ and $Q_4$. This provides the more moderate portion of each curve from point B to point C. The value of resistor $R_{2b}$ and the current gain of transistors $Q_3$ and $Q_4$ are what determine the location B on each of the curves of FIG. 2.

Resistors $R_{2b}$ and $R_{2d}$ are selected to obtain the desired steep slope of each curve between its A point and its B point. $R_{2a}$ serves to establish a bias for transistor $Q_1$. $R_{2c}$ serves to establish initial voltage gain for the circuit.

It should be apparent that various modifications of the above will be evident to those skilled in the art and the arrangement described herein is for illustrative purposes and is not to be considered restrictive.

What is claimed is:

1. A method of controlling the amount of light provided by fluorescent lamps at a prescribed location in accordance with any selected one of a family of predetermined curves, each of said curves having a portion with a steep slope joined to a portion with a more moderate slope than said steep slope, said method including sensing the amount of illumination provided at the prescribed location by natural light and by said fluorescent lamps, selecting one of said family of curves, said fluorescent lamps being controlled to provide a large amount of light in accordance with the steep slope of said selected curve when the amount of sensed illumination is in a low range and being controlled to provide a lesser amount of light than said larger amount in accordance with said more moderate portion of said curve when the amount of sensed illumination is at a degree higher than said low range.

2. A method according to claim 1, wherein the amount of light sensed at the bottom of said steep slope is approximately 1.105 times the amount sensed at the top of said steep slope.

3. A method according to claim 1, wherein the amount of light provided by said fluorescent lamps at the bottom of said steep slope is approximately 70% of the amount provided at the top of said steep slope.

4. A method according to claim 2, wherein the amount of light provided by said fluorescent lamps at the bottom of said steep slope is approximately 70% of the amount provided at the top of said steep slope.

5. A method according to any one of claims 1, 2, 3 or 4, wherein the amount of light sensed at the bottom of said more moderate slope is at least approximately 3.2 times that of the amount sensed at the top of said steep slope.

6. A method according to claim 5, wherein the amount of light provided by said fluorescent lamps at the bottom of said more moderate slope is approximately 20% of the amount provided at the top of said steep slope.

7. A method according to any one of claims 1, 2, 3 or 4, wherein the amount of light provided by said fluorescent lamps at the bottom of said more moderate slope is approximately 20% of the amount provided at the top of said steep slope.

8. A control circuit for a fluorescent lamp dimmer, said control circuit being for connection to a ballast for fluorescent lamps, said control circuit operating to control the amount of light provided by said fluorescent lamps at a prescribed location in accordance with any selected one of a family of predetermined curves, said control circuit including light sensing means sensing the amount of illumination at the prescribed location provided by natural light and by said fluorescent lamps, selection means for selecting one of said family of curves, each of said curves having a steep slope when said light sensing means indicates said fluorescent lamps should provide a high amount of light and a more moderate slope when said light sensing means indicates said fluorescent lamps should provide a lesser amount than said high amount, said control circuit including determining means for determining at what amount of light from said fluorescent lamps each of said curves is transposed from said steep slope to said more moderate slope.

9. A control circuit for a fluorescent lamp dimmer according to claim 8, said control circuit including a photo amplifier comprising a pair of transistors which operate at a high current gain at low natural light levels.

10. A control circuit for a fluorescent lamp dimmer according to claim 9, wherein one of said pair of transistors saturates at a relatively high natural light level.

11. A control circuit for a fluorescent lamp dimmer according to claim 10, wherein said selection means includes a rheostat connected to the emitter of the other of said pair of transistors.

12. A control circuit for a fluorescent lamp dimmer according to claim 11, wherein said determination means includes a resistor connected to the collector of said one of said transistors.

13. A control circuit for a fluorescent lamp dimmer according to claim 12, wherein said determination means includes a resistor connected across the collector and emitter of said one of said pair of transistors.

14. A control circuit for a fluorescent lamp dimmer according to claim 13, wherein said light sensor senses approximately 1.105 times the amount of light at the bottom of said steep slope than at the top of said steep slope.

15. A control circuit for a fluorescent light dimmer according to claim 14, wherein said determination means operates so that approximately 70% of the amount of light provided at the top of said steep slope is provided at the bottom of said steep slope.

16. A control circuit for a fluorescent lamp dimmer according to claim 13, wherein said light sensing means at the bottom of said more moderate slope senses at least approximately 3.2 times the amount of light sensed at the top of said steep slope.

17. A control circuit for a fluorescent light dimmer according to claim 14, wherein said determination means operates so that approximately 20% of the amount of light provided at the top of said steep slope is provided at the bottom of said more moderate slope.

* * * * *